US009222216B2

(12) United States Patent
Mukhopadhyay et al.

(10) Patent No.: US 9,222,216 B2
(45) Date of Patent: Dec. 29, 2015

(54) METHODS FOR ENZYMATIC TREATMENT OF WOOL

(71) Applicant: University of Calcutta, Kolkata, West Bengal (IN)

(72) Inventors: Arka Mukhopadhyay, Howrah (IN); Krishanu Chakraborti, Kolkata (IN); Nalok Dutta, Kolkata (IN)

(73) Assignee: UNIVERSITY OF CALCUTTA, Kolkata (IN)

( * ) Notice: Subject to any disclaimer, the term of this patent is extended or adjusted under 35 U.S.C. 154(b) by 0 days.

(21) Appl. No.: 14/681,849

(22) Filed: Apr. 8, 2015

(65) Prior Publication Data

US 2015/0292147 A1 Oct. 15, 2015

(30) Foreign Application Priority Data

Apr. 9, 2014 (IN) ..... 445/KOL/2014

(51) Int. Cl.
*D06M 16/00* (2006.01)
*D06M 13/285* (2006.01)

(52) U.S. Cl.
CPC ..... *D06M 16/003* (2013.01)

(58) Field of Classification Search
CPC ..... D06M 13/285; D06M 16/003
See application file for complete search history.

(56) References Cited

U.S. PATENT DOCUMENTS

| | | | |
|---|---|---|---|
| 5,529,928 | A | 6/1996 | Ciampi et al. |
| 6,051,033 | A | 4/2000 | McDevitt et al. |
| 2009/0286302 | A1 | 11/2009 | Liu et al. |

FOREIGN PATENT DOCUMENTS

| | | |
|---|---|---|
| EP | 0134267 | 3/1985 |
| EP | 0358386 | 3/1990 |
| EP | 1507919 | 3/2008 |
| GB | 2258655 | 2/1993 |
| JP | 03213574 | 9/1991 |
| WO | WO 9827264 | 6/1998 |
| WO | WO 0214595 | 2/2002 |
| WO | WO 03097927 | 11/2003 |

OTHER PUBLICATIONS

Cavaco-Paulo, A. and Almeida, L., "Cellulase activities and finishing effects," Textile Chemist & Colorist, vol. 28, Issue 6, pp. 28-32 (Jun. 1996).

Cortez, J. et al., "Application of transglutaminases in the modification of wool textiles," Enzyme and Microbial Technology, vol. 34, Issue No. 1, pp. 64-72 (2004).

Dutta, N., "Nanotechnology Enabled Enhancement of Enzyme Activity and Thermostability: Study on Impaired Pectate Lyase from Attenuated Macrophomina phaseolina in Presence of Hydroxyapatite Nanoparticle," PLOS One, vol. 8, Issue 5, pp. 1-12 (May 15, 2013).

Glaser, L., "Industrial Uses of Agricultural Materials Situation and Outlook," Commercial Agriculture Division, Economic Research Service, U.S. Department of Agriculture, pp. 3, (Jul. 1997).

Pearson, J. et al., "Disposal of wool scouring sludge by composting," AUTEX Research Journal, vol. 4, Issue 3, pp. 147-156 (Sep. 2004).

Sousa F. et al., "A novel metalloprotease from *Bacillus cereus* for protein fibre processing," Enzyme and Microbial Technology, vol. 40, Issue 7, pp. 1772-1781 (Jun. 1, 2007).

*Primary Examiner* — Maryam Monshipouri
(74) *Attorney, Agent, or Firm* — Foley & Lardner LLP

(57) ABSTRACT

Disclosed are methods for enzymatic treatment of wool using bacterial protease, cellulase, and xylanase enzymes.

10 Claims, 3 Drawing Sheets

METHODS FOR ENZYMATIC TREATMENT OF WOOL

CROSS-REFERENCE TO RELATED APPLICATIONS

This application claims priority to Indian Application No. IN 445/KOL/2014, filed on Apr. 9, 2014, the content of which is herein incorporated by reference in its entirety.

TECHNICAL FIELD

This disclosure relates generally to methods and compositions for the enzymatic treatment of wool. In certain embodiments, the disclosure relates to increasing the lustre of wool, and removing animal and vegetable contaminants from wool.

BACKGROUND

The following description is provided to assist the understanding of the reader. None of the information provided or references cited is admitted to be prior art.

The utilization of enzymes in the textile industry has been known and applied commercially for many years. For example, amylases were used for desizing of cotton and cellulases for indigo abrasion on denim, and proteases were used for wool and silk processing and for the surface modification of cashmere fibres.

SUMMARY

This disclosure provides methods and compositions for the treatment of wool with protease, cellulase and xylanase enzymes in the presence of calcium hydroxyapatite nanoparticles (CaHAp), resulting in improved fibre quality and increased fibre lustre and fineness.

The methods described herein relate to enzymatic treatment of wool. In one aspect, the present disclosure provides a method for enzymatic treatment of wool fibres, the method comprising contacting the wool fibres with a composition comprising at least one protease, at least one cellulase, at least one xylanase, and a plurality of calcium hydroxyapatite nanoparticles.

In another aspect, the present disclosure provides a composition for enzymatic treatment of wool fibres, the composition comprising at least one protease, at least one cellulase, at least one xylanase, and a plurality of calcium hydroxyapatite nanoparticles.

In yet another aspect, the present disclosure provides a kit for enzymatic treatment of wool fibres comprising at least one protease, at least one cellulase, at least one xylanase, and a plurality of calcium hydroxyapatite nanoparticles. The kit can further comprise instructions for use. In some embodiments, the protease, cellulase, and xylanase are bacterial enzymes.

DETAILED DESCRIPTION

Figure 1:
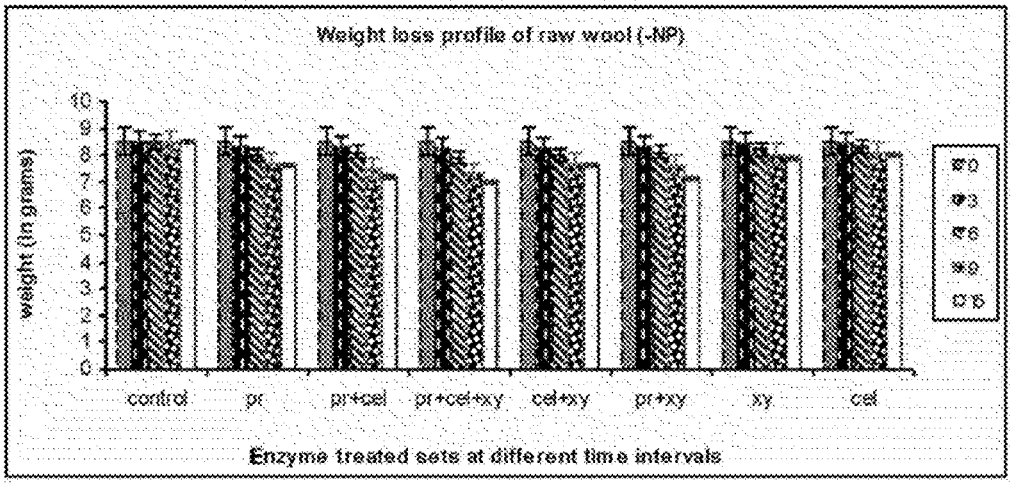
FIG. 1 is a chart showing the weight loss profile of raw wool treated with a bacterial protease, cellulase, and xylanase in the absence of calcium hydroxyapatite nanoparticles.

In the following detailed description, reference may be made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

The disclosure provides enzyme based methods for treating wool and/or wool fibres that result in increased shrink resistance, increased softness, and improve handling of the wool, while minimizing fibre damage and environmental impact. The technology relates to treating wool fibres in an aqueous solution with protease, cellulase and xylanase enzymes in presence of calcium hydroxyapatite nanoparticles.

The scalar nature of wool is responsible for many of its properties, and is primarily responsible for its tendency to shrink. One way to achieve shrink-resistance is to remove the scales from the surface of wool. This process is not industrially feasible for a number of reasons, in particular because of the loss of weight and strength of wool fibres that occur. An ideal commercial process for imparting shrink resistance would alter the physical nature of the fibre without significantly weakening the fibre. At the molecular level, chemical bonds are ruptured causing degradation of wool proteins, which causes a reduction in strength and weight of the fibre. The process described in this disclosure is an alternative to these harsh treatments, opening avenues for altering the texture of wool fibres without damaging them.

The present disclosure describes methods that use three enzymes in the presence of a nanoparticle activator to modify the surface structure of wool fibres while also minimizing fibre degradation. The inner layer of the wool fibre contains non-keratin protein, which is easily digested by proteases. The proteolytic enzymes cleave amide bonds, whereas cellular matrix carboxymethyl cellulose (CMC) is easily degraded by cellulase. Xylanase aids in this process and removes lignin, reducing fibre damage, effluent load and energy consumption.

The use of calcium hydroxyapatite nanoparticles increases the activities of the already charged enzymes, and their heightened activities bring about a change in the wool structure with regard to increased shrink resistance, and/or improvements of softness and handle.

The methods, compositions, and kits described herein are useful for processing wool with reduced environmental impact compared to conventional methods for wool processing, where an increase in fibre fineness and lustre are desired. The methods, compositions, and kits described herein are useful for the production of textile fibres having a high degree of insulation, health, water repellence, fire resistance, resilience, versatility, static resistance, acoustical insulation, resistance to soiling, fashion, ease of dyeing, and/or comfort.

This disclosure provides methods, compositions, and kits for enzymatic treatment of wool fibres. The technology is described herein using several definitions, as set forth throughout the specification.

As used herein, unless otherwise stated, the singular forms "a," "an," and "the" include plural reference. Thus, for example, a reference to "an enzyme" includes a plurality of enzyme molecules, and a reference to "a wool fibre" is a reference to one or more wool fibres.

As used herein, the terms "wool" and "wool fibres" refer generally textile fibers obtained from wool-producing animals. The terms encompass all varieties and qualities of wool, including, but not limited to, wool from sheep, goats, rabbits, alpaca, camelids, llamas, and muskoxen. The term encompasses wool varieties including, but not limited to, shetland wool, merino wool, lambswool, loden wool, melton wool, alpaca wool, quivut, mohair, angora, cashmere, and camel hair. As used herein, the terms also encompass all grades of wool and wool fibres, including, but not limited to, virgin wools (first shearing or unprocessed), super wools (e.g., super 100's, super 110's, super 120's, super 150's, etc.), boiled wools, worsted wools, and tropical weight wools.

As used herein, the "weight" of wool fibres refers to the dry weight of wool fibers measured using methods routine in the art. In some embodiments, the weight of wool fibres prior to enzymatic treatment reflects the presence of animal-based or vegetable-based contaminants. In some embodiments, enzymatic treatment with a protease, a cellulase, and a xylanase in the presence of calcium hydroxyapatite nanoparticles removes animal-based and plant-based contaminants, and reduces the weight of wool fibers compared to untreated wool fibers. In some embodiments, the weight of wool fibres is decreased due to a decrease in the diameter of the fibres. In some embodiments, the decrease in fibre diameter is due to the removal of material from the outer surface or surfaces of the wool fibre.

As used herein, the "fineness" of wool fibers refers generally to the diameter of a wool fibre given in microns, as measured using methods routine in the art, including, but not limited to, airflow and microscopic methods. As known in the art, smaller diameter fibers are comparatively referred to as "finer," and are generally softer and of higher commercial value than fibres of a greater diameter. In some embodiments, enzymatic treatment with a protease, a cellulase, and a xylanase in the presence of calcium hydroxyapatite nanoparticles increases the fineness of wool fibers compared to untreated wool fibers.

As used herein, the "lustre" of wool fibres refers generally to the sheen, gloss or shine of the fiber, due to the reflection of light.

As used herein, "vegetable-based" and "animal-based" "contaminants" refers generally to non-wool plant and animal materials present in raw wool, the removal of which is required or typical in wool processing. The terms include, but are not limited to, skin, burrs, seeds, grass, sticks, and straw.

As used herein, the term "protease" refers generally to enzymes that perform proteolysis (that is, hydrolyze peptide bonds). As used herein, the term encompasses proteases from any source, such as, but not limited to, proteases produced by animals, plants, bacteria, archaea and viruses, and proteases of any classification, including, but not limited to serine proteases, threonine proteases, cysteine proteases, aspartate proteases, glutamic acid proteases, and metalloproteases. The term encompasses natural, engineered, semi-engineered, and recombinant, proteases, of all grades or degrees of purity. In some embodiments, a protease is used in combination with a cellulase and a xylanase for the treatment of wool fibres. In some embodiments, the protease is used in combination with calcium hydroxyapatite nanoparticles for the treatment of wool fibres. In some embodiments, the protease is used in combination with a cellulase, a xylanase, and calcium hydroxyapatite nanoparticles for the treatment of wool fibres. In some embodiments, the protease is a bacterial enzyme.

As used herein, the term "cellulase" refers to generally to enzymes that catalyze cellulolysis (that is, the hydrolysis of 1,4-beta-D-glycosidic linkages in cellulose). The term encompasses cellulases derived from any source, including, but not limited to fungi, bacteria, and protozoans, and encompasses all classes of cellulases, including, but not limited to endocellulases, exocellulases, cellobiases, oxidative cellulases, and cellulose phosphorylases. The term encompasses natural, engineered, semi-engineered, and recombinant, cellulases, of all grades or degrees of purity. In some embodiments, a cellulase is used in combination with a protease and a xylanase for the treatment of wool fibres. In some embodiments, the cellulase is used in combination with calcium hydroxyapatite nanoparticles for the treatment of wool fibres. In some embodiments, a cellulase is used in combination with a protease, a xylanase, and calcium hydroxyapatite nanoparticles for the treatment of wool fibres. In some embodiments, the cellulase is a bacterial enzyme.

As used herein, the term "xylanase" refers generally to enzymes that degrade the linear polysaccharide beta-1,4-xylan into xylose, thereby removing lignin from wool fibres. The term encompasses xylanases derived from any source, including, but not limited to, bacteria, actinomycetes, and fungi, and encompasses all classes of xylanase. The term encompasses natural, engineered, semi-engineered, and recombinant, xylanases, of all grades or degrees of purity. In some embodiments, a xylanase is used in combination with a protease and a cellulase for the treatment of wool fibres. In some embodiments, the xylanase is used in combination with calcium hydroxyapatite nanoparticles for the treatment of wool fibres. In some embodiments, a xylanase is used in combination with a protease, a cellulase, and calcium hydroxyapatite nanoparticles for the treatment of wool fibres. In some embodiments, the xylanase is a bacterial enzyme.

As used herein, the term "calcium hydroxyapatite nanoparticles" refers to particles of calcium hydroxyapatite ($Ca_{10}(PO_4)_6(OH)_2$) on the order of 1-100 nanometers in diameter. The term refers to calcium hydroxyapatite nanoparticles produced by any method known in the art, such as, but not limited, to electrospinning, sintering, or a combination thereof, and encompasses calcium hydroxyapatite nanoparticles of any grade or degree of purity. In some embodiments, calcium hydroxyapatite nanoparticles are used in combination with a protease, a cellulase, and a xylanase for the treatment of wool fibres. In some embodiments, the calcium hydroxyapatite nanoparticles increase the activities of the protease, the cellulase, and the xylanase in the treatment of wool fibres, increasing the fineness and lustre of treated wool fibres.

The present disclosure provides methods, compositions, and kits for removal of vegetable matters and skin flakes from wool fibres with less damage to the fibres, less effluent load, and less energy consumption. The method comprises enzymatic treatment of wool fibres with a nanoparticle (NP)-activated protease, cellulase, and xylanase. The methods produce wool fibres with increased fineness and luster compared to untreated wool fibres.

Compositions

In one aspect, the present disclosure provides a composition for the enzymatic treatment of wool. In some embodiments, the composition comprises at least one protease, at least one cellulase, and at least one xylanase, in combination with calcium hydroxyapatite nanoparticles. As described herein, the at least one protease, cellulase, and xylanase may be derived from any source, and are defined by their respective capacities for proteolysis, cellulolysis, and degradation of beta-1,4-xylan into xylose. Accordingly, one of skill in the art will understand that any enzyme isoforms with these capacities are suitable for use in the composition.

In some embodiments, the at least one protease, cellulase, and xylanase are derived from bacteria. One of skill in the art will understand that any bacterial protease, cellulase, and xylanase having the activities described above are suitable for use in the composition. In some embodiments, the enzymes are bacterial. One of skill in the art will understand that the enzymes may be derived from bacteria including, but not limited to, *Cellulomonas flavigena, Teredinibacter turnerae, Bacillus amovivorus, Bacillus licheniformis, Bacillus cereus*, and *Paenibacillus thailandensis.*

In some embodiments, the at least one protease of the composition is derived from a proteolytic bacterial strain identified by the "casein" method. As known in the art, the method comprises the isolation of bacterial colonies on agar-azo-casein media, with proteolytic bacteria exhibiting a zone of precipitation surrounding the colony corresponding to casein breakdown.

In some embodiments the at least one cellulase of the composition is derived from a cellulolytic bacterial strain identified by the "congo-red" method. As known in the art, the method comprises the isolation of bacterial colonies on CMC-agar media and flooded with congo-red solution, with cellulolytic bacteria exhibiting a halo surrounding the colony.

In some embodiments, the at least one xylanase of the composition is derived from a bacterial strain identified by the "congo-red" method. As known in the art, the method comprises the isolation of bacterial colonies on xylan-agar media and flooded with congo-red solution, with xylan-producing bacteria exhibiting a halo surrounding the colony.

Each enzyme can be present in the composition at generally any concentration, such as a concentration of about 2 μg/ml to about 13.0 μg/ml, including both endpoints. In some embodiments, each enzyme is present at a concentration of about 2.0 μg/ml, about 2.5 μg/ml, about 3.0 μg/ml, about 3.5 μg/ml, about 4.0 μg/ml, about 4.5 μg/ml, about 5.0 μg/ml, about 5.5 μg/ml, about 6.0 μg/ml, about 6.5 μg/ml, about 7.0 μg/ml, about 7.5 μg/ml, about 8.0 μg/ml, about 8.5 μg/ml, about 9.0 μg/ml, about 9.5 μg/ml, about 10.0 μg/ml, about 10.5 μg/ml, about 11.0 μg/ml, about 11.5 μg/ml, about 12.0 μg/ml, about 12.5 μg/ml, about 13.0 μg/ml, or ranges between any two of these values. One of skill in the art will understand that the enzyme concentration will depend on the specific activity of the particular enzyme in use, and that that the impact of enzyme concentration adjustments on the efficacy of the composition may be determined empirically using methods described herein and exemplified below.

The composition can generally have any pH, such as a pH of about 2.0 to about 10.0. In some embodiments, the pH is about 2.0, about 2.2, about 2.4, about 2.6, about 2.8, about 3.0, about 3.2, about 3.4, about 3.6, about 3.8, about 4.0, about 4.2, about 4.4, about 4.6, about 4.8, about 5.0, about 5.2, about 5.4, about 5.6, about 5.8, about 6.0, about 6.2, about 6.4, about 6.6, about 6.8, about 7.0, about 7.2, about 7.4, about 7.6, about 7.8, about 8.0, about 8.2, about 8.4, about 8.6, about 8.8, about 9.0, about 9.2, about 9.4, about 9.6, about 9.8, about 10.0, or ranges between any two of these values. In some embodiments, the composition is at pH 8.0. One of skill in the art will understand that the pH of the composition may be adjusted using methods routine in the art, and that the pH of the composition reflects a pH at which the enzymes in the composition exhibit suitable levels of activity. One of skill in the art will further understand that the impact of pH adjustments on the efficacy of the composition may be determined empirically using methods described herein and exemplified below.

Calcium hydroxyapatite nanoparticles of the composition may be prepared by any method known in the art, including but not limited to electrospinning, sintering, or a combination thereof. Calcium hydroxyapatite nanoparticles increase the activity of proteases, cellulases, and xylanases. The composition generally includes calcium hydroxyapatite nanoparticles at a concentration of about 2.0 μg/ml to about 13 μg/ml. In some embodiments, the concentration of calcium hydroxyapatite nanoparticles is about 2.0 μg/ml, about 2.5 μg/ml, about 3.0 μg/ml, about 3.5 μg/ml, about 4.0 μg/ml, about 4.5 μg/ml, about 5.0 μg/ml, about 5.5 μg/ml, about 6.0 μg/ml, about 6.5 μg/ml, about 7.0 μg/ml, about 7.5 μg/ml, about 8.0 μg/ml, about 8.5 μg/ml, about 9.0 μg/ml, about 9.5 μg/ml, about 10.0 μg/ml, about 10.5 μg/ml, about 11.0 μg/ml, about 11.5 μg/ml, about 12.0 μg/ml, about 12.5 μg/ml, about 13.0 μg/ml, or ranges between any two of these values. One of skill in the art will understand that the impact of calcium hydroxyapatite nanoparticles concentration adjustments on the efficacy of the composition may be determined empirically using methods described herein and exemplified below.

The enzymes of the composition are typically active at a temperature of about 25° C. to about 70° C. In some embodiments, the enzymes are active at a temperature of about 25° C., about 30° C., about 35° C., about 40° C., about 45° C., about 50° C., about 55° C., about 60° C., about 65° C., about 70° C., about 75° C., or ranges between any two of these values. One of skill in the art will further understand that the impact of temperature adjustments on the efficacy of the composition may be determined empirically using methods described herein and exemplified below.

Methods

In one aspect, the disclosure provides methods for enzymatic treatment of wool or wool fibers. In one embodiment, the method comprises contacting wool fibres with a composition as described above comprising at least one protease, at least one cellulase, at least one xylanase, and a plurality of calcium hydroxyapatite nanoparticles.

According to the method, each enzyme is present in the composition at generally any concentration, such as a concentration of about 2 μg/ml to about 13.0 μg/ml. In some embodiments, each enzyme is present at a concentration of about 2.0 μg/ml, about 2.5 μg/ml, about 3.0 μg/ml, about 3.5 μg/ml, about 4.0 μg/ml, about 4.5 μg/ml, about 5.0 μg/ml, about 5.5 μg/ml, about 6.0 μg/ml, about 6.5 μg/ml, about 7.0 μg/ml, about 7.5 μg/ml, about 8.0 μg/ml, about 8.5 μg/ml, about 9.0 μg/ml, about 9.5 μg/ml, about 10.0 μg/ml, about 10.5 μg/ml, about 11.0 μg/ml, about 11.5 μg/ml, about 12.0 μg/ml, about 12.5 μg/ml, about 13.0 μg/ml, or ranges between any two of these values. One of skill in the art will understand that the enzyme concentration may depend in part on the specific activity of the particular enzyme in use, and that that the impact of enzyme concentration adjustments on the efficacy of the method may be determined empirically using methods described herein and exemplified below. One of skill will further understand that one or more enzymes of the composition may be adjusted or replenished during the course of the method according to operator preference.

According to the method, the calcium hydroxyapatite nanoparticles of the composition may be prepared by any method known in the art, including but not limited to electrospinning, sintering, or a combination thereof. The method generally comprises the use of a composition comprising calcium hydroxyapatite nanoparticles at generally any concentration, such as a concentration of about 2.0 μg/ml to about 13 μg/ml. In some embodiments, the concentration of calcium hydroxyapatite nanoparticles is about 2.0 μg/ml, about 2.5 μg/ml, about 3.0 μg/ml, about 3.5 μg/ml, about 4.0 μg/ml, about 4.5 μg/ml, about 5.0 μg/ml, about 5.5 μg/ml, about 6.0 μg/ml, about 6.5 μg/ml, about 7.0 μg/ml, about 7.5 μg/ml, about 8.0 μg/ml, about 8.5 μg/ml, about 9.0 μg/ml, about 9.5 μg/ml, about 10.0 μg/ml, about 10.5 μg/ml, about 11.0 μg/ml, about 11.5 μg/ml, about 12.0 μg/ml, about 12.5 μg/ml, about 13.0 μg/ml, or ranges between any two of these values. One of skill in the art will understand that the impact of calcium hydroxyapatite nanoparticles concentration adjustments on the efficacy of the method may be determined empirically using methods described herein and exemplified below. One of skill will further understand that calcium hydroxyapatite nanoparticles may be adjusted or replenished during the course of the method according to operator preference.

According to the method, the composition in contact with wool fibres is maintained at a pH, such as a pH of about 2.0 to about 10.0 during the performance of the method. In some embodiments, the pH is maintained at about 2.0, about 2.2, about 2.4, about 2.6, about 2.8, about 3.0, about 3.2, about 3.4, about 3.6, about 3.8, about 4.0, about 4.2, about 4.4, about 4.6, about 4.8, about 5.0, about 5.2, about 5.4, about 5.6, about 5.8, about 6.0, about 6.2, about 6.4, about 6.6, about 6.8, about 7.0, about 7.2, about 7.4, about 7.6, about 7.8, about 8.0, about 8.2, about 8.4, about 8.6, about 8.8, about 9.0, about 9.2, about 9.4, about 9.6, about 9.8, about 10.0, or ranges between any two of these values. In some embodiments, the pH is maintained at about 8.0. One of skill in the art will understand that the pH of the composition may be adjusted using methods routine in the art, and that the pH of the composition reflects a pH at which the enzymes in the composition exhibit suitable levels of activity. One of skill in the art will further understand that the impact of pH adjustments on the efficacy of the method may be determined empirically using methods described herein and exemplified below. One of skill in the art will further understand that the pH of the composition may be adjusted as necessary during the course of the method, or according to operator preference.

According to the method, the composition in contact with wool fibres is maintained at a temperature, such as a temperature of about 25° C. to about 70° C. In some embodiments, the method is maintained at a temperature of about 25° C., about 30° C., about 35° C., about 40° C., about 45° C., about 50° C., about 55° C., about 60° C., about 65° C., about 70° C., about 75° C., or ranges between any two of these values. One of skill in the art will understand that the impact of temperature adjustments on the efficacy of the method may be determined empirically using methods described herein and exemplified below. One of skill in the art will further understand that the temperature of the method may vary during the course of the method in a stepwise or gradient manner, according to operator preference.

According to the method, the composition is maintained in contact with wool fibres for generally any period of time, such as a period of time of about 3 hours to about 15 hours. In some embodiments, the method comprises contacting the wool fibres with the composition for about 3 hours. In some embodiments, the method comprises contacting the wool fibres with the composition for about 15 hours. In some embodiments, the method comprises contacting the wool fibres with the composition for about 3, about 4, about 5, about 6, about 7, about 8, about 9, about 10, about 11, about 12, about 13, about 14, about 15 hours, or ranges between any two of these values. One of skill in the art will understand that the duration of the method determines the characteristics of the resulting wool product, and may be adjusted according to operator preferences.

According to the method, enzymatic treatment of wool fibres with at least one protease, at least one cellulase, and at least one xylanase results in increased lustre of the wool fibres relative to their lustre before the enzymatic treatment. The lustre of wool fibres may be assessed using methods known in the art, including but not limited to, visual inspection of the fibres prior to and following treatment. Illustrative increases in lustre resulting from enzymatic treatment of wool fibres with at least one protease, at least one cellulase, and at least one xylanase is shown in the examples provided herein.

According to the method, enzymatic treatment of wool fibres with at least one protease, at least one cellulase, and at least one xylanase results in increased fineness of the wool fibres relative to their fineness before the enzymatic treatment. The fineness of wool fibres may be assessed using techniques known in the art, such as those endorsed by the International Wool Textile Organisation (IWTO), including, but not limited to, Laserscan (IWTO-12), Optical-based Fibre Diameter Analyser (OFDA) (IWTO-47), and Airflow (IWTO-12) techniques. According to the method, fineness may be estimated by visual inspection of the fibres prior to and following treatment. Illustrative increase in fineness resulting from enzymatic treatment of wool fibres with at least one protease, at least one cellulase, and at least one xylanase is shown in the examples provided herein.

According to the method, enzymatic treatment of wool fibres with at least one protease, at least one cellulase, and at least one xylanase results in reduced weight of the wool fibres relative to their weight before the enzymatic treatment. Reductions in the weight of wool fibres may be assessed using methods known in the art, including but not limited to, measuring the weight of a unit of wool prior to and following treatment. Illustrative reductions in the weight of wool fibres resulting from enzymatic treatment of wool fibres with at least one protease, at least one cellulase, and at least one xylanase are shown in the examples provided herein.

According to the method, enzymatic treatment of wool fibres with at least one protease, at least one cellulase, and at least one xylanase results in removal of animal and/or vegetable contaminants from the wool fibres relative to before the enzymatic treatment. The degree of contamination of wool fibres may be assessed using methods known in the art, including but not limited to, visual and microscopic inspection of the wool fibres.

Kits

In one aspect, the disclosure provides a kit for enzymatic treatment of wool or wool fibers. In one embodiment, the kit comprises one or more compositions for the enzymatic treatment of wool fibres as described above, comprising at least one protease, at least one cellulase, at least one xylanase, a plurality of calcium hydroxyapatite nanoparticles, and instructions for use.

As described herein, the at least one protease, cellulase, and xylanase may be derived from any source, and are defined by their respective capacities for proteolysis, cellulolysis, and degradation of beta-1,4-xylan into xylose. Accordingly, one of skill in the art will understand that any enzyme isoforms with these capacities are suitable for use in the composition.

In some embodiments, the at least one protease, cellulase, and xylanase are derived from bacteria. One of skill in the art will understand that any bacterial protease, cellulase, and xylanase having the activities described above are suitable for use in the composition. In some embodiments, the enzymes are bacterial. One of skill in the art will understand that the enzymes may be derived from bacteria including, but not limited to, *Cellulomonas flavigena, Teredinibacter turnerae, Bacillus amovivorus, Bacillus licheniformis, Bacillus cereus*, and *Paenibacillus thailandensis*.

EXAMPLES

The present compositions, methods and kits, thus generally described, will be understood more readily by reference to the following examples, which are provided by way of illustration and are not intended to be limiting of the present methods and kits.

Example 1

Isolation and Identification of Protease, Cellulase- and Xylanase-Secreting Bacteria from Soil This example demonstrates the isolation of a protease-, cellulase-, and xylanase-producing bacterial strains for use in the methods, compositions, and kits described herein.

A protease-secreting (proteolytic) bacterial strain was isolated using the "Casein" method, as known in the art. Bacterial isolates were grown on agar-azo-casein plates. Those displaying a zone of white precipitation surrounding the colony, corresponding to casein breakdown, were identified as proteolytic bacterial strains. Cultures of protease-secreting bacteria were maintained at 37° C.

A xylanase-secreting bacterial strain was isolated using the 'Congo red' method, as known in the art. Bacterial isolates were grown on xylan-agar plates and flooded with Congo-red solution. Those displaying a halo surrounding the colony were identified as xylanase secreting bacteria. Cultures of xylanase-secreting bacteria were maintained at 30° C.

A cellulose-secreting (cellulolytic) bacterial strain was isolated using the 'Congo red' method, as known in the art. Bacterial isolates were grown on CMC-agar plates and flooded with Congo-red solution. Those displaying a halo surrounding the colony were identified as xylanase secreting bacteria. Cultures of cellulose-secreting bacteria were maintained at 30° C.

Example 2

Purification of Protease, Cellulase, and Xylanase Enzymes

This example demonstrates the isolation or purification of enzymes from bacterial strains identified in Example 1.

Protease was purified from the bacteria of Example 1 using three consecutive steps: 1) a 30-70% ammonium sulfate cut method, 2) ion exchange chromatography (CM Sepharose), and 3) gel filtration chromatography (Sephadex G-50).

Cellulase was purified from the bacteria of Example 1 using three consecutive steps: 1) a 0-80% ammonium sulfate cut method, 2) ion exchange chromatography (DEAE cellulose), and 3) gel filtration chromatography (Sephadex G-100).

Xylanase was partially purified from the bacteria of Example 1 using two consecutive steps: 1) ion exchange chromatography (CM Sepharose), and 2) gel filtration chromatography (Sephadex G-75).

Example 3

Measurement of Enzymatic Activities

This example demonstrates measurement of activities of protease, cellulase, and xylanase enzymes produced by the bacterial isolates of Example 1.

Protease activity was assayed by azo-casein method, as known in the art. Protease was incubated with 1% (w/v) azo-casein for 10 minutes at 37° C. in 25 mM Tris-Cl buffer of pH 8.5. The reaction was stopped by the addition of 4 ml of 5% (v/v) trichloroacetic acid, and the reaction was centrifuged at 3000×g for 10 minutes. One milliliter of the was supernatant was combined with 5 ml of 0.4 M $Na_2CO_3$, followed by addition of 0.5 ml Folins Ciocalteu's reagent. The optical density was measured at 660 nm in a U.V. spectrophotometer. Results are shown in Table 1.

Cellulase activity was measured using the dinitrosalicylic acid method, as known in the art. One milliliter of cellulase preparation was diluted with 2 ml of distilled water, followed by the addition of 3 ml of DNS reagent. The solution was heated in a boiling water bath for 5 minutes. After heating, the contents were allowed to cool at room temperature, and 7 ml of freshly prepared 40% sodium potassium tartrate solution was added. The optical density was measured at 510 nm in a U.V. spectrophotometer, and the amount of reducing sugar was determined using a standard graph. Results are shown in Table 1.

Xylanase activity was assayed using 1% solution of Birchwood xylan as a substrate and the amount of reducing sugars released was determined using a dinitrosalicylic acid method, as known in the art. One unit of enzyme activity was defined as 1 mM xylose equivalent produced per minute under the given conditions. The optical density was measured at 410 nm in a U.V. spectrophotometer. Results are shown in Table 1.

TABLE 1

Protease, Cellulase, and Xylanase Activity

| Sample No. | Enzyme Activity (units/ml) |
|---|---|
| Protease Activity | |
| 1 | 56.78 ± 1.22 |
| 2 | 59.91 ± 2.34 |
| 3 | 55.19 ± 1.12 |
| 4 | 60.05 ± 2.00 |
| Cellulase Activity | |
| 1 | 71.82 ± 2.12 |
| 2 | 69.67 ± 1.53 |
| 3 | 70.07 ± 1.09 |
| 4 | 71.72 ± 2.11 |
| Xylanase Activity | |
| 1 | 62.45 ± 0.09 |
| 2 | 61.12 ± 1.23 |
| 3 | 60.09 ± 0.91 |
| 4 | 63.43 ± 1.11 |

Example 4

Enzymatic Treatment of Raw Wool by Enzymes in Presence of Hydroxyapatite Nanoparticles This example demonstrates the use of protease, cellulase, and xylanase enzymes produced by the bacterial isolates of Example 1 and purified or partially purified in Example 2 for the enzymatic treatment of raw wool in the presence of hydroxyapatite nanoparticles.

Methods

The following experimental conditions were used to demonstrate enzymatic treatment of raw wool in the presence of hydroxyapatite nanoparticles using the protease, cellulase, and xylanase of described above.

Raw wool fibres (8.5 gm dry weight) containing various contaminants were treated separately with purified bacterial protease, cellulase, and xylanase of identical concentrations of (2 μg/ml) according to the following scheme: (1) control; (2) protease; (3) protease+cellulase; (4) protease+xylanase; (5) protease+xylanase+cellulase; (6) xylanase; (7) cellulase; (8) xylanase and cellulase.

Wool fibres were submerged completely for the duration of the treatment. All treatments were maintained at pH 8.0 using Tris-HCl buffer, 50° C. in the presence or absence of hydroxyapatite nanoparticles (10.5 μg/ml) with shaking at 130 rpm. Fibres were then dried at 105° C. until completely moisture free and weighed individually. Fineness and lustre were assessed by visual estimation prior to and following treatment.

The optimum treatment period for the method was determined by treating replicates for periods of 0, 3, 6, 9, and 15 hours.

The optimum temperature and pH for the method were determined by treating replicates at 37° C., 42° C., 50° C., 60° C., and 70° C., and at pH 2, 4, 6, 8 and 10.

Results

Figure 2:
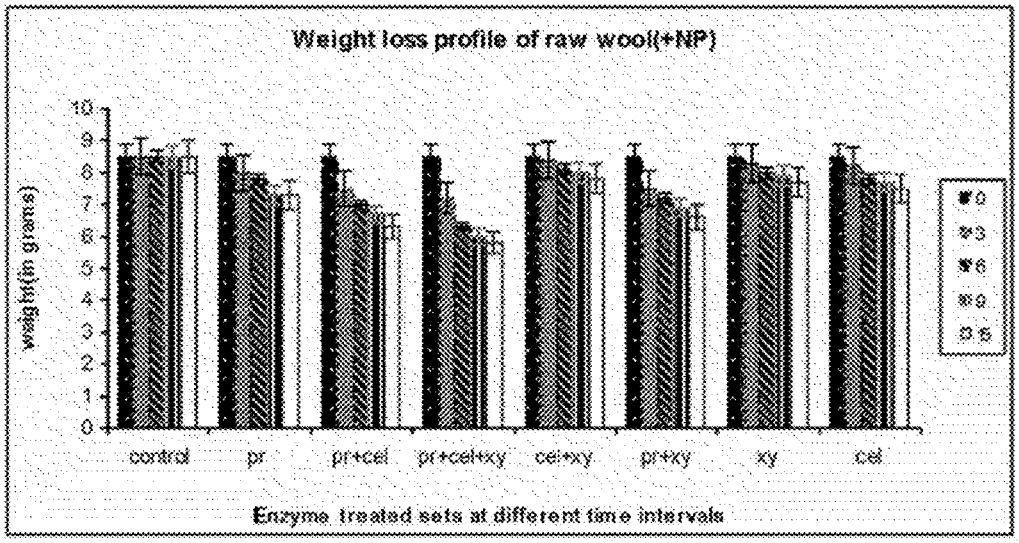
FIG. 2 is a chart showing the weight loss profile of raw wool treated with a bacterial protease, cellulase, and xylanase in the presence of calcium hydroxyapatite nanoparticles.
Figure 3:
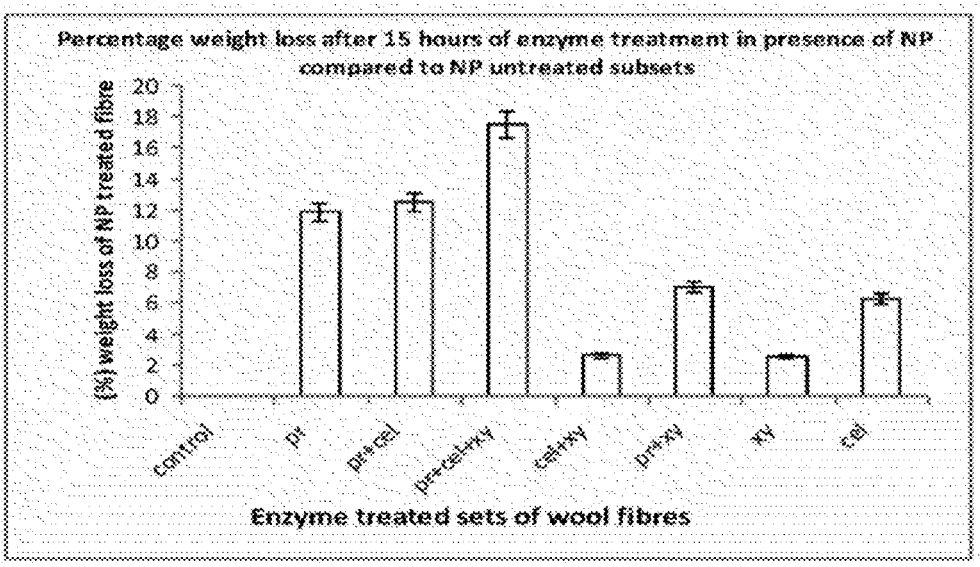
FIG. 3 is a chart showing the percentage weight loss of wool fibres treated for 15 hours with a bacterial protease, cellulase, and xylanase in the presence of calcium hydroxyapatite nanoparticles.

Results show that maximal reduction of wool fibre weight occurred with treatment of the fibres simultaneously with a protease, a cellulase, and a xylanase for a period of 15 hours (FIGS. 1, 2), and that the presence of hydroxyapatite nanoparticles during the treatment resulted in a 17.7% decrease in fibre weight compared to wool fibres treated with enzymes in the absence of hydroxyapatite nanoparticles (FIG. 3).

Figure 4:
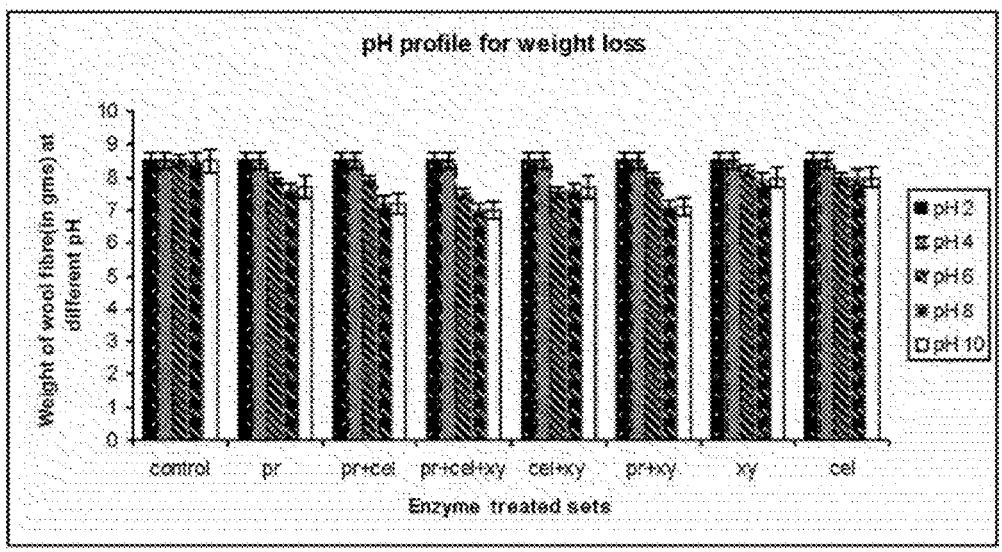
FIG. 4 is a chart showing the weight loss profile of wool fibres treated with a bacterial protease, cellulase, and xylanase at different pH values in the presence of calcium hydroxyapatite nanoparticles.
Figure 5:
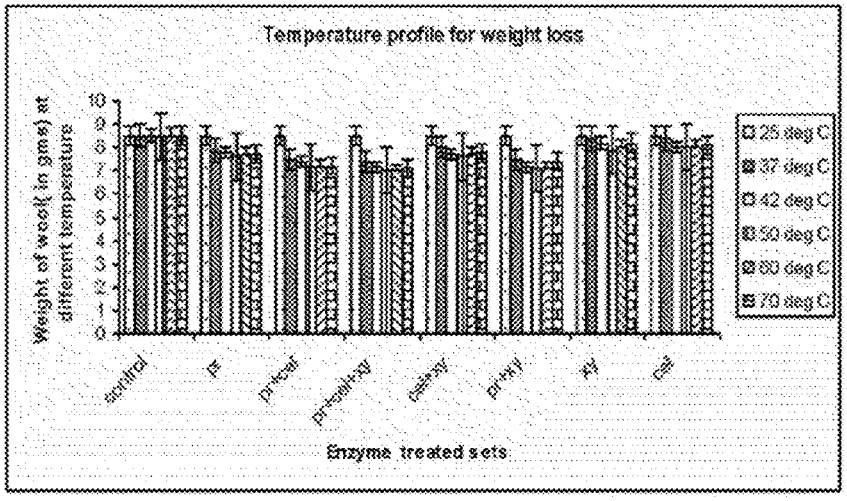
FIG. 5 is a chart showing the weight loss profile of wool fibres treated with a bacterial protease, cellulase, and xylanase at different temperatures in the presence of calcium hydroxyapatite nanoparticles.

Results further show that the wool fibre weight loss is optimal when treatment conditions are maintained at about pH 8.0 (FIG. 4) at a temperature of about 50° C. (FIG. 5).

Figure 6:
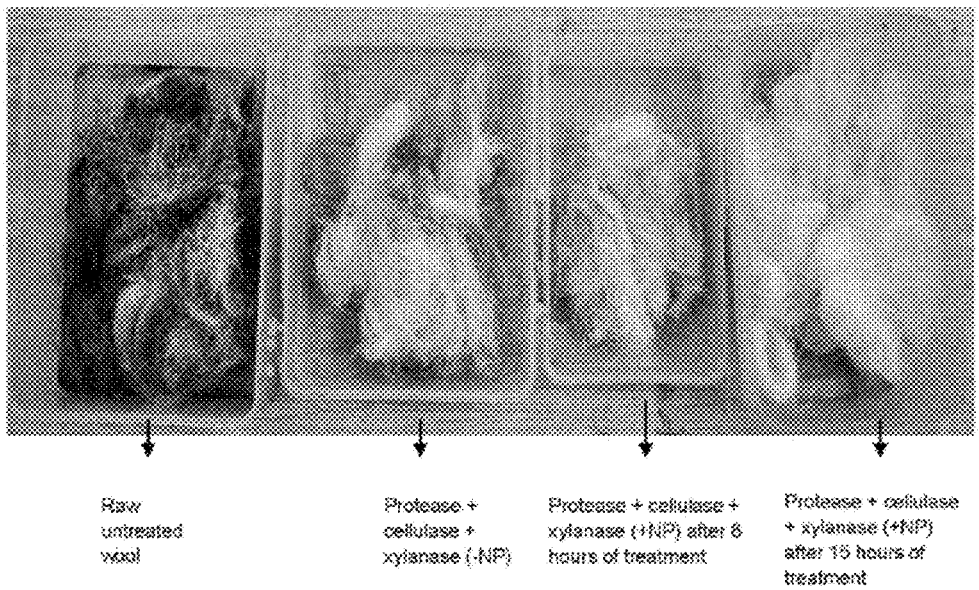
FIG. 6 shows the physical appearance of raw wool fibres compared to wool fibres treated for 15 hours with bacterial protease, cellulase, and xylanase in the absence of calcium hydroxyapatite nanoparticles (panel 2), treated for 8 hours with bacterial protease, cellulase, and xylanase in the presence of calcium hydroxyapatite nanoparticles (panel 3), and treated for 15 hours with bacterial protease, cellulase, and xylanase in the presence of calcium hydroxyapatite nanoparticles (panel 4).

After 15 hours of treatment at pH 8.0, the fibres showed increased lustre and fineness compared to untreated wool fibres (FIG. 6).

These results show that the methods, compositions, and kits of the present disclosure are useful for the enzymatic treatment of wool fibres to increase the fineness and lustre of wool fibers.

The present disclosure is not to be limited in terms of the particular embodiments described in this application. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 particles refers to groups having 1, 2, or 3 particles. Similarly, a group having 1-5 particles refers to groups having 1, 2, 3, 4, or 5 particles, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A method for enzymatic treatment of wool fibres, the method comprising contacting the wool fibres with a composition comprising at least one protease, at least one cellulase, at least one xylanase, and a plurality of calcium hydroxyapatite nanoparticles.

2. The method of claim 1, wherein the protease, the cellulase, and the xylanase are bacterial enzymes.

3. The method of claim 1, wherein the contacting step is performed at a temperature of about 25° C. to about 70° C.

4. The method of claim 1, wherein the contacting step is performed at pH of about 2.0 to about 10.0.

5. The method of claim 1, wherein the contacting step is performed for a period of about 3 hours to about 15 hours.

6. A composition for enzymatic treatment of wool fibres, the composition comprising at least one protease, at least one cellulase, at least one xylanase, and a plurality of calcium hydroxyapatite nanoparticles.

7. The composition of claim 6, wherein the protease, the cellulase, and the xylanase are bacterial enzymes.

8. The composition of claim 6, wherein the composition has a pH of about 2.0 to about 10.0.

9. A kit for enzymatic treatment of wool fibres, the kit comprising:

at least one protease;

at least one cellulase;

at least one xylanase;

a plurality of calcium hydroxyapatite nanoparticles; and instructions for use.

10. The kit of claim 9, wherein the protease, cellulase, and xylanase are bacterial enzymes.

* * * * *